United States Patent [19]

Detilleux et al.

[11] Patent Number: 4,991,322

[45] Date of Patent: Feb. 12, 1991

[54] DEVICE FOR AFFIXING CUTTER DRUMS TO AN APPARATUS INTENDED FOR CUTTING TRENCHES IN THE GROUND

[75] Inventors: Jean-Claude Detilleux, Les Ulis; Gilbert Ferre, Bondy; Philippe LeFort, Brunoy; André Ponsada, Rueil Malmaison; Jean-Pierre Schreiber, Mareil-sur-Mauldre; Jean-Bernard Wittner, Clamart, all of France

[73] Assignee: Soletanche, Nanterre, France

[21] Appl. No.: 464,442

[22] Filed: Jan. 12, 1990

[30] Foreign Application Priority Data

Jan. 13, 1989 [FR] France ..... 89 00390

[51] Int. Cl.[5] ..... E02F 3/24

[52] U.S. Cl. ..... 37/189; 37/91; 403/370; 403/383

[58] Field of Search ..... 403/365, 368, 370, 383; 37/91, 92, 94, 189

[56] References Cited

U.S. PATENT DOCUMENTS

| | | | |
|---|---|---|---|
| 2,732,641 | 1/1956 | Jespersen | 37/189 |
| 3,390,473 | 7/1968 | Williams | 37/190 |

FOREIGN PATENT DOCUMENTS

| | | | |
|---|---|---|---|
| 0249551 | 12/1987 | European Pat. Off. . | |
| 0262050 | 3/1988 | European Pat. Off. . | |
| 221490 | 4/1985 | Fed. Rep. of Germany | 37/91 |
| 1511232 | 1/1968 | France . | |
| 909790 | 11/1962 | United Kingdom | 37/91 |
| 1405715 | 9/1975 | United Kingdom | 403/370 |

*Primary Examiner*—Randolph A. Reese
*Assistant Examiner*—Arlen L. Olsen
*Attorney, Agent, or Firm*—Schweitzer Cornman & Gross

[57] ABSTRACT

The invention relates to a device for affixing cutter drums on an apparatus designed to cut trenches in the ground.

The driver includes a revolving plate 4 disposed perpendicular to its axis and to the end of the latter, the plate having on its periphery a convex polygonal shape 9. A cutter drum 8 is provided with a portion 8*a* including a central hollow of concave polygonal shape 10 corresponding to the convex polygonal shape 9 of the plate 4 and of slightly greater dimensions. Bolts 11 unite the cutter drum 8 to the said plate 4 such that the rotational driving of the cutter drum 8 by the plate is performed through the medium of the aforesaid polygonal surfaces 9, 10 which come into engagement with one another.

5 Claims, 2 Drawing Sheets

DEVICE FOR AFFIXING CUTTER DRUMS TO AN APPARATUS INTENDED FOR CUTTING TRENCHES IN THE GROUND

BACKGROUND OF THE INVENTION

The present invention relates to a device for affixing cutter drums to an apparatus intended for cutting trenches in the ground.

Apparatus which enable holes of great depth to be made in the ground and filled with bentonite clay are known, which have on their lower part two assemblies each having one pair of half-drums situated on either side of a vertical supporting core to which the driving unit is fastened.

These cutting apparatus are operated in ground of a highly variable nature, such as alluvial soils which offer but little resistance to the cutting, or dense rock of extreme hardness.

The cutting apparatus must therefore be adaptable to different operating conditions, for example by varying its speed of rotation or the torque applied to the cutterheads, but also by using different cutterheads, differing, for example, in width or in the nature and number of cutters.

In the cutting apparatus known heretofore, the changing of the cutter drums is a long and difficult operation.

The present invention relates to a device permitting this change to be made in a simple and quick manner, while providing an extremely reliable fastening of the cutter drum on its driver.

SUMMARY OF THE PRESENT INVENTION

The subject matter of the present invention is a device for fastening cutter drums to an apparatus intended for cutting trenches in the ground, characterized by the fact that the driver has a revolving plate disposed perpendicular to its axis and to the end of the latter, the plate having on its periphery a convex polygonal shape, whereas the cutter drum is equipped with a collar having a central cavity of concave polygonal shape corresponding to the convex polygonal shape of the plate of the driver and slightly larger dimensions, holding means uniting the cutter drum to the said plate such that the rotational driving of the cutter drum by the plate is performed through the medium of the above-mentioned polygonal surfaces which come in engagement with one another.

In a preferred embodiment of the invention, the collar of the cutter drum is attached to the plate of the driver by bolts disposed between the crests of the polygonal surfaces providing for the driving of the cutter drum.

In an improved embodiment of the invention the periphery of the driver plate has a convex truncatoconical surface which engages in a concave truncatoconical surface of matching shape affixed to the cutter drum to assure the precise positioning of the cutter drum with respect to the driver.

By this feature there is obtained a complete dissociation of the three functions which it is necessary to assure for the fixation of the cutter drum on the drive assembly.

First of all, the positioning and particularly the coaxiality of the cutter drum with the axis of the driver is assured by the two truncatoconical surfaces in engagement with one another.

The uniting of the plate of the driver to the collar of the cutter drum is then provided by bolts under such conditions that they do not appreciably participate in the transmission of the cutting torque, for example due to the fact that they pass through an opening whose dimensions are sufficiently broad.

Lastly, the transmission of the cutter torque is assured by the cooperation of the above-mentioned polygonal surfaces.

According to one preferred embodiment of the invention, the polygonal surfaces are hexagons which offer the advantage of effectively performing the function of torque transmission, while leaving sufficient room to place between their crests the six bolts which fasten the cutter drum to the plate of the driver.

In a variant, it is possible according to the invention to make the polygonal surfaces, not with generatrices parallel to the axis of the drum, but by giving them a truncated pyramid shape, which permits them to serve simultaneously the positioning function and the rotational driving function, in which case the truncatoconical surfaces become useless.

To enable the invention to be understood more easily, a description will now be given by way of explanation without restricting it thereto, of an embodiment taken as example and represented in the drawing.

DESCRIPTION OF THE DRAWINGS

In this drawing:

FIG. 1 is a diagrammatic cross section along line I—I of

FIG. 2 is a diagrammatic left-side view of FIG. 1.

DESCRIPTION OF THE PREFERRED EMBODIMENT

Figure 1:
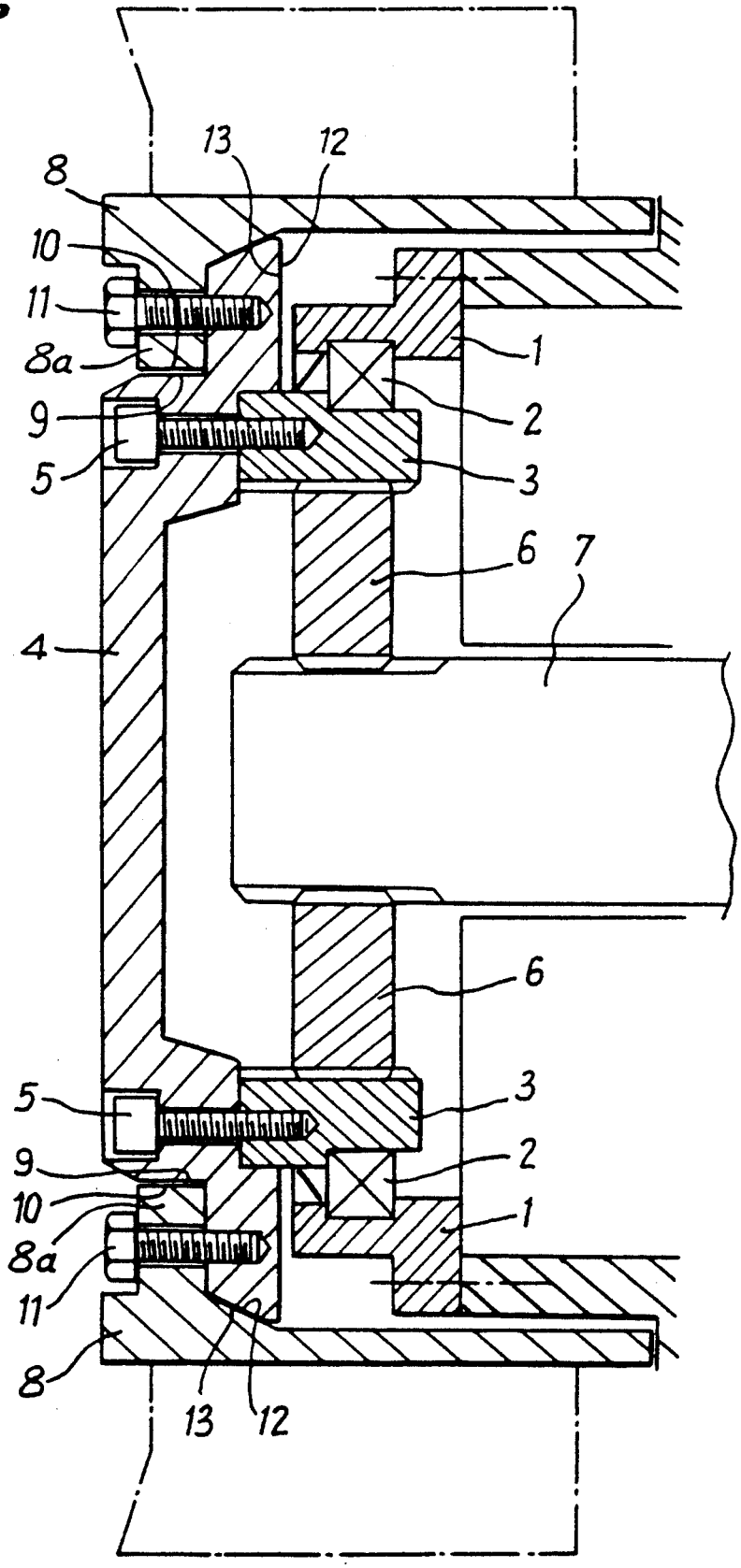

In the embodiment represented in the drawing the driver supports an end gear 1 which is affixed to the vertical core supporting the assembly consisting of the driver and the cutter drums. This end gear 1 bears a rolling bearing 2 which holds an internal gear 3 to which a plate 4 is affixed by bolts 5.

The gear 3 has internal teeth engaging the external teeth of a wheel 6 which also has a central opening provided with internal teeth engaged with the external teeth of the shaft 7 of the driver.

On account of this arrangement, the driver causes the rotation of the plate 4 which is held in position by the bearing 2, while nevertheless assuring a certain free play in the positioning of shaft 7 with respect to the plate 4.

In a variant, the shaft 7 can drive the gear 3 and plate 4 through intermediate pinions or an epicycloid train.

Figure 2:
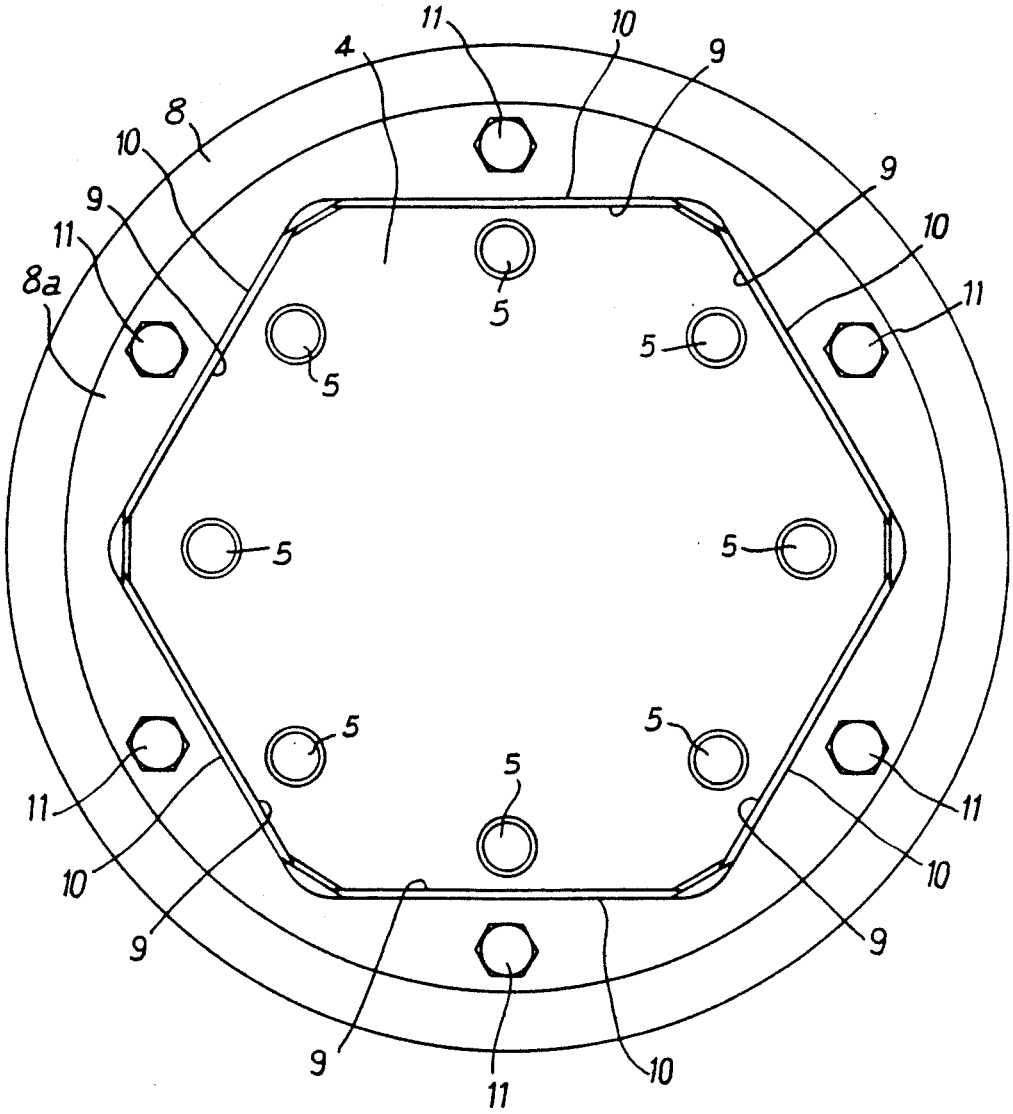
FIG. 2 of the end of a driver provided with the cutter drum fastening device according to the invention.

In FIG. 2 is seen the plate 4 on which the cutter drum 8 is affixed, in accord with the invention.

To this effect, the plate 4 has on its periphery an external polygonal surface 9 whose generatrices are parallel to the axis of the driver. The portion 8*a* of the cutter drum 8 has at its internal periphery a polygonal surface 10 of a shape corresponding to that of the polygonal surface 9, but of very slightly larger dimensions, such that the cutter drum 8, 8*a*, can be easily engaged against the plate 4.

In FIG. 2, in which the clearance between polygonal surface 9 and polygonal surface 10 has been exaggerated for clarity of the drawing, it will be seen that the crests 9a of the polygonal surface 9 have been sectioned, whereas the hollows 10a of the polygonal surface 10 have been rounded.

In this manner it is assured that the drive torque is well provided by the major part of the surfaces of the sides of the polygons 9 and 10 which, in the present case, are hexagons.

Portion 8a of the cutter drum 8 is fastened to the plate 4 by bolts 11 which are threaded into taps in plate 4 and pass through portion 8a of the cutter drum 8 through holes whose dimensions are sufficient so that the drive torque will be transmitted by the sides of the polygonal surfaces 9 and 10 when these sides come in contact with one another, not by the shearing of the bolts 11.

According to an improved embodiment of the invention, and as it can be seen in FIG. 1, the periphery of the plate 4 has a truncatoconical surface 12 whose axis corresponds to the axis of rotation of the plate 4, the crest of the cone of this surface facing toward the outside of the cutting apparatus.

The cutter drum 8 has a concave truncatoconical surface of matching shape 13 which, by applying itself against the truncatoconical surface 12, permits assuring the precise positioning of the cutter drum 8 on the driver.

To proceed to the assembly of the cutter drum 8, the drum is placed around the driver by bringing the concave truncatoconical surface 13 in contact with the convex truncatoconical surface 12 while arranging it so that the holes in portion 8a of the drum are in such a position that they permit the bolts 11 to be tightened enough to hold the drum 8 temporarily on the driver.

Then a torque is exerted between the plate 4 and the cutter drum 8 in the direction of operation of the cutter, so as to bring the polygonal surfaces 9 and 10 into engagement with one another.

After that the bolts 11 are finally tightened to assure the rigidity of the assembly.

To disassemble a cutter drum, it suffices to loosen the bolts 11 to enable the drum to be disengaged since the angle of the truncatoconical surfaces 9 and 10 is greater than the friction angle.

It can be seen that, owing to the invention, the mounting and removal of the cutter drums are performed in a particularly simple manner, making it possible to change them, without loss of time, each time that the characteristics of the soil require it.

It is well understood that the embodiment that has been described is by no means limitative, and that it can be given any desirable modifications without thereby departing from the scope of the invention.

In particular, it is clear that, in a simplified version, it is possible not to make the surfaces 12 and 13 truncatoconical; in this case, the thrust of the polygonal surfaces 9 and 10 one against the other assures both the axial positioning and the transmission of the torque, while the bolts 11 serve only to unite these two elements.

In another variant, it is also possible to make the polygonal surfaces 9 and 10, not with generatrices parallel to the axis, but with generatrices inclined so as to give them a pyramidal shape.

In this case, the surfaces 9 and 10 provide both for the axial positioning of the drum 8 and its rotation.

We claim:

1. Device for fastening cutter drums on an apparatus designed to cut trenches in the ground comprising:

a driver which includes a revolving plate 4 disposed perpendicularly across an end of a shaft 7 on the driver, said plate having on its periphery a convex polygonal shape 9:

a cutter drum 8 with a portion 8a including a central recess of concave polygonal shape 10 connected to and of slightly greater dimensions than the convex polygonal shape 9 of the plate 4; and a holding means 11 uniting the cutter drum 8 to said plate 4 such that the rotational driving motion of the cutter drum 8 by the plate 4 is performed through said convex and concave polygonal shapes 9, 10 which come into engagement one with the other.

2. Device according to claim 1, characterized by the fact that the portion 8a of the cutter drum 8 is connected to the plate 4 of the driver by bolts 11 disposed between the crests of the polygonal surfaces 9, 10 which provide for the driving of the cutter drum.

3. Device according to claim 1, characterized by the fact that the periphery of the plate 4 of the driver has a convex truncatoconical surface 12 which engages a concave truncatoconical surface 13 of corresponding shape affixed to the cutter drum 8.

4. Device according to claim 1, characterized by the fact that the polygonal surfaces 9, 10 have the shape of trunks of pyramids.

5. Device according to claim 1, characterized by the fact that the polygonal surfaces 9, 10 are hexagonal.

* * * * *